United States Patent [19]

Bell et al.

[11] Patent Number: 4,884,410

[45] Date of Patent: Dec. 5, 1989

[54] PURGE/CHARGE MANIFOLD AND METHOD FOR CRYOGENIC SYSTEMS

[75] Inventors: Steven H. Bell, Leominster; Mark A. Stira, Wilmington; James Blotzer, Winthrop, all of Mass.

[73] Assignee: Helix Technology Corporation, Waltham, Mass.

[21] Appl. No.: 234,913

[22] Filed: Aug. 22, 1988

[51] Int. Cl.[4] ..... G25B 45/00

[52] U.S. Cl. ..... 62/77; 62/292; 141/311 R; 141/348

[58] Field of Search ..... 62/292, 77; 141/311 R, 141/348

[56] References Cited

U.S. PATENT DOCUMENTS 3,996,765 12/1976 Mullins ..... 62/292

OTHER PUBLICATIONS

Schematic drawing of a charging manifold and purge value (CTI-Cryogenics 8197004, May 1985).

*Primary Examiner*—Ronald C. Capossela

*Attorney, Agent, or Firm*—Hamilton, Brook, Smith & Reynolds

[57] ABSTRACT

A T-shaped manifold employs a single multiway control valve for purging and charging a cryogenic system of interest. The single multiway control valve is positioned at the intersection of a crossbar and perpendicular elongate member. One end of the crossbar is associated with a source of working gas. the opposite end of the crossbar provides a purge or check valve outlet. One end of the elongate member is connected to the multiway control valve and an opposite end is coupled by a VCO fitting to the cryogenic system of interest. At one setting, the single multiway control valve provides working gas to the system through the one end of the crossbar and elongate member. At a second setting, the multiway control valve allows gas to be vented from the system to ambient through the elongate member and the purge valve outlet. An in-line pressure gauge connected to the elongate member provides an indication of ingoing flow as well as outgoing flow of gas during respective charging and purging of the system. An in-line filter of the elongate member prevents particulate contamination of the flowing gases.

22 Claims, 1 Drawing Sheet

PURGE/CHARGE MANIFOLD AND METHOD FOR CRYOGENIC SYSTEMS

BACKGROUND OF THE INVENTION

In closed cryogenic refrigeration systems, high purity grades of a working gas (i.e., helium) are used. Cooler temperatures are produced when unwanted gases (i.e., nitrogen and oxygen) are eliminated from the cryogenic system. A technique called purging and charging aids in the process of obtaining the desired high purity grade of the working gas. In the purging and charging technique, working gas from a source is allowed to enter the cryogenic system in a controlled manner. That is, the cryogenic system is charged with the working gas. After a desired amount of working gas has entered the system the transferring of working gas from the source to the system is temporally ceased. The cryogenic system is then vented or purged of gas within the system which at this time is a mixture of the working gas and other gases. After a certain amount of the unwanted mixture of gases is vented from the system the purging is ceased. The cryogenic system is then recharged with working gas from the source and then repurged in an alternating manner until a raised level of concentration or high purity grade of the working gas exists within the system.

Various devices which enable this purging/charging process have been developed. In a typical purging/-charging device, an assembly of tubes and valves is employed. A first tube connects the working gas source with the cryogenic system. A second tube is connected to the first tube and provides a relief port for the cryogenic system. A first valve is used to open one end of the first tube to the cryogenic system. A second valve is used to open the opposite end of the first tube connected to the source of working gas. A third or relief valve is used to open and close the second tube.

In order to charge the system with a supply of the working gas, the first two valves must be opened and the third valve closed. After the desired amount of working gas has been transferred to the cryogenic system, the first or system valve is closed to temporarily isolate the system, and the second or supply valve is closed to stop the supply of working gas from the source. The relief valve on the second tube is opened to provide an outlet for the system. The system valve is then opened to allow purging of the system. After sufficient purging, the system valve is closed to allow the relief valve to be closed and the supply valve to be reopened for recharging. Upon reopening of the system valve the cryogenic system is recharged, and so on.

Accordingly, the purging and charging process involves the opening and closing of the three valves which becomes cumbersome and is often confusing and awkward. A further disadvantage of such purging/-charging devices is that one or more of the valves may not be completely closed causing unaccounted leakage, and hence the purging and charging is not accurately accomplished.

SUMMARY OF THE INVENTION

The present invention provides a T-shaped manifold having a crossbar and a main section intersecting perpendicularly with the crossbar. One end of the crossbar is associated with the source of working gas, and an opposite end of the crossbar is connected to a purge or check valve. A head end of the main section intersects the crossbar, and a tail end of the main section opposite the crossbar end provides a port associated with the cryogenic system of interest. A multiway valve is positioned at the intersection of the crossbar and the main section of the T-shaped manifold. The multiway valve at one setting allows working gas to flow from the source through the main section to the tail/port end and into the cryogenic system. A second setting of the multiway valve allows gas within the cryogenic system to be vented out through the main section to the opposite end of the crossbar and out the purge valve. The multiway valve is repeatedly changeable between the one and second settings to alternately charge the cryogenic system with the working gas and purge the system of unwanted gas respectively. Such changing between the two settings, to thereby charge and purge the cryogenic system, provides an increased level of concentration of the working gas within the system.

In accordance with one aspect of the present invention, the one end of the crossbar is connected to a pressure regulator of the source such that the working gas enters the cryogenic system at a predetermined pressure level when the multiway valve is set at the one setting.

In addition, the purge valve is preferably adjustable to allow venting of the unwanted gas through the second setting of the multiway valve at a desired rate.

In accordance with another aspect of the present invention, an in-line pressure gauge may be mounted to the main section of the manifold. The pressure gauge so mounted provides an indication of the pressure of the working gas entering the cryogenic system as well as the pressure of the unwanted gas flowing out of that system.

Further, an in-line filter may be connected to the main section of the manifold between the pressure gauge and the tail/port end. The in-line filter serves to prevent particulate contaminants from entering the cryogenic system and thus further ensures purity of the contents of the system.

Another feature of the present invention involves the use of a VCO (Vacuum Coupling o-ring)fitting to couple the tail/port end to the cryogenic system of interest. The VCO fitting enables rotational movement of the manifold main section about a longitudinal axis while maintaining a pressure seal between the tail/port end and the system. In addition the VCO fitting is finger tightened and loosened and hence does not require the wrenches and tools required for tightening/loosening prior art devices.

It is preferred that the working gas is a clean, compressed gas. In addition, the working gas is preferably helium.

In addition to providing an increased level of concentration of the working gas in the cryogenic system, the device also provides for the pressurizing of the system.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENT

Figures 1, 2, 3:
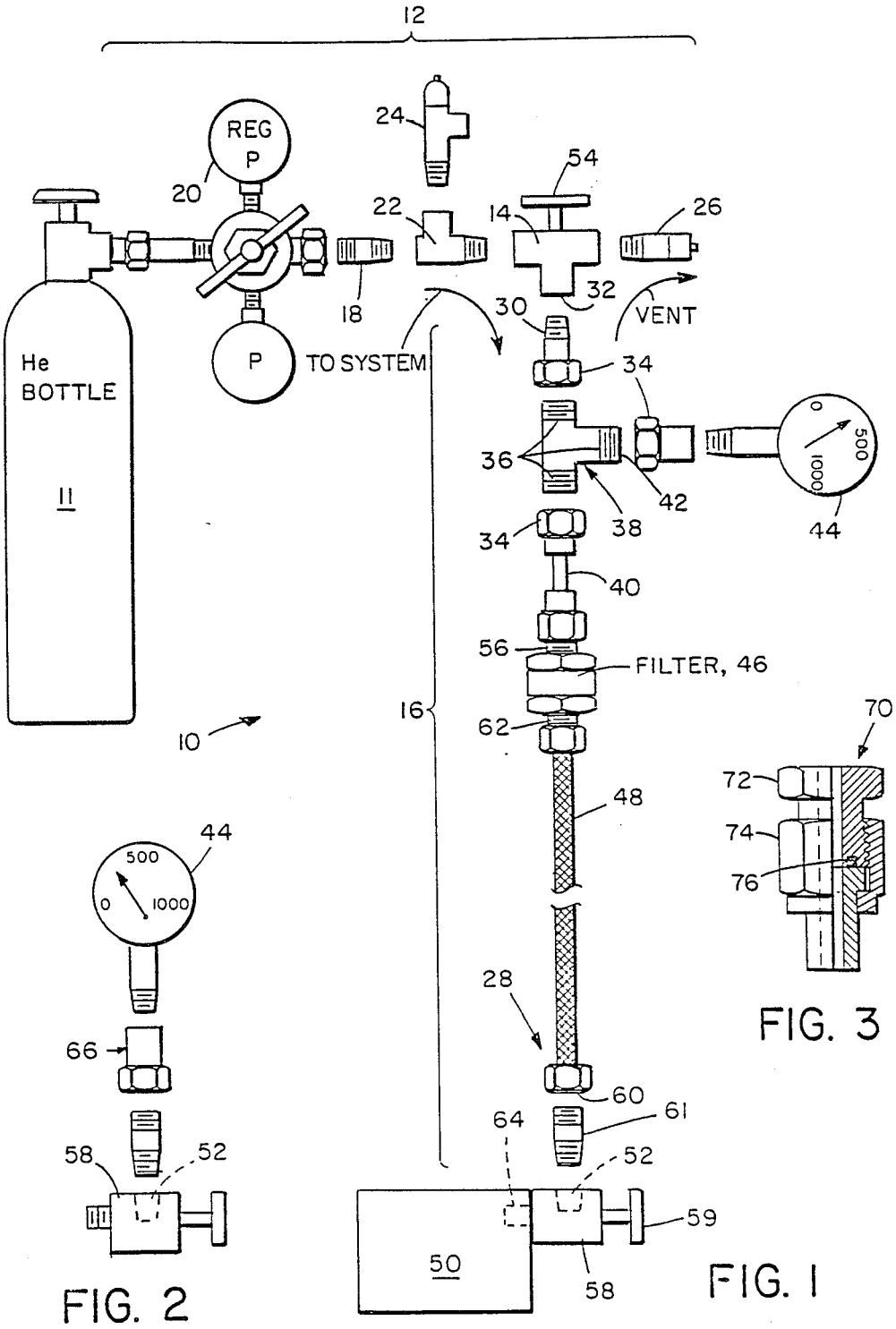
FIG. 1 is an exploded view of a purge/charge manifold embodying the present invention for purging a cryogenic system.
FIG. 2 is a side view of a pressure gauge of the embodiment of FIG. 1 coupled directly to the cryogenic system.
FIG. 3 is a side view, partially cut away, of a VCO fitting employed in the manifold of FIG. 1.

The present invention discloses a single valve device for purging and charging a cryogenic system of interest. The single valve device overcomes the awkwardness and confusion of existing purge/charge devices which typically employ a system of several valves. The single valve of the device determines the flow of gases to and from the cryogenic system of interest. At one setting, the single valve allows gas to flow from a source to the cryogenic system. At a second setting, the valve allows gas to flow from the cryogenic system to ambient. At a third setting, the valve disallows any gas flow into or out of the cryogenic system. The single valve is preferably a three-way valve, but is not limited to such. Hence, the following discussion refers to the single valve as a multiway control valve.

A device embodying the present invention is shown in FIG. 1. The device 10 can be generally described as a T-shaped manifold assembly having a crossbar 12 with a centrally located multiway control valve 14 and an elongate member 16 perpendicularly connected to the crossbar 12 at a port 32 of the control valve 14. The crossbar 12 comprises a series of piping 18, 22, 26 threaded to each side of the control valve 14.

As herein used an "outward" orientation refers to a direction along the major axis of the crossbar 12 leading away from the control valve 14, and an "inward" orientation refers to a direction leading toward the control valve 14 along the major axis of the crossbar 12.

A pipe element 18 is positioned at one end of crossbar 12 and receives pressurized working gas from a supply or source 11. Between the supply 11 and pipe element 18 lies a pressure regulator 20 which enables the predetermination of the pressure level of the working gas as it leaves the supply 11. The pressure regulator 20 is of the type which is common in the art, and the supply of working gas is connected to the pressure regulator 20 in a conventional manner.

The pipe element 18 has an inwardly directed opening which is threaded or otherwise adapted to connect to a first T-joint 22 which provides a continuation from the one end of pipe element 18 to the multiway control valve 14 through a side port of the valve. The first T-joint 22 also provides a perpendicular connection of a pressure relief valve 24 to the crossbar 12. Other means may be used to connect the pressure relief valve 24 to the crossbar 12 and the multiway control valve 14. The pressure relief valve 24 preferably has a spring which is user adjustable to obtain a desired pressure level, for example in the range of about 750 psi to about 1500 psi. Other ranges of pressure level may be employed. Such a pressure relief valve 24 is of the type manufactured by Nupro Corporation of Willoghby, Ohio. Similar pressure relief valves are suitable.

A purge valve 26 is connected to a side port of the multiway control valve 14 directed opposite the side port connected to the first T-joint 22. The purge valve 26 forms the end of the crossbar 12 opposite the one end of the crossbar 12 which is coupled to the pressure regulator 20. The purge valve 26 provides an output port for the device and preferably enables adjustment of the rate of the flow of the outgoing gases. The position of the purge valve 26 and the associated end of the crossbar 12 is designed to direct the released and outgoing gases away from the operator of the device. Such a design provides a safety feature not present in prior art devices where the outgoing gases are potentially released at a direction toward the operator.

Preferably purge valve 26 is of the type manufactured by Nupro Corp. of Ohio. Other purge or check valves are suitable.

The elongate member 16 of the manifold 10 transfers gas to and from a cryogenic system 50 of interest which is connected to a tail end 28 of the elongate member. The elongate member is formed by a plurality of piping elements connected in series.

A head end piece 30 of the elongate member 16 is connected perpendicularly to the crossbar 12 at a port 32 of the control valve 14 as previously mentioned. In practice, the head end piece 30 is a short pipe threaded on each end, one end of which screws into the control valve port 32. The opposite end is connected to a thread adapter for adapting the pipe thread of the head end piece 30 to a conventional VCO (Vacuum Coupling 0-Ring) fitting 34, 36 of a second T-joint 38. The second T-joint 38 provides a continuation from the thread adapter of head end piece 30 to a tubing adapter 40, and provides a port 42 for connecting an in-line pressure gauge 44. Each connecting end or port of the second T-joint 38 preferably comprises a VCO fitting 34, 36 formed of a male portion 36 and a cooperating female portion 34.

The pressure gauge 44 being positioned in-line on the elongate member 16 provides a reading of the ingoing flow and the outgoing flow of gases during respective charging and purging of the cryogenic system 50. In addition, the pressure gauge 44 may be designed to be adaptably connected to the access hole 52 of cryogenic system 50 to provide an indication of the system pressure as discussed later.

The tubing adapter 40 is a stainless steel tube which serves as a connector between the VCO fitting 34, 36 of the second T-joint 38 and a VCO fitting 56 to a two micron filter 46. The filter 46 traps debris which has entered the elongate member 16 and prevents particulate contamination of the flowing gases. In the preferred embodiment filter 46 is of the type manufactured by Nupro Corp. of Ohio, however, similar filters are suitable.

An end of the filter 46 opposite the VCO fitting 56 to the tubing adapter 40 is connected by another VCO fitting generally referenced 62 to a hose 48 which leads to the system 50 of interest. The hose 48 is preferably a stainless steel braided hose of about ten feet in length or of sufficient length to reach the cryogenic system 50. The hose 48 serves as a tail end 28 of the elongate member 16, and the system end of the hose preferably employs a VCO fitting 60, 61 to be secured to a port or opening of the cryogenic system 50.

In the preferred embodiment, VCO fitting 60, 61 is coupled to an adapter 58 through access hole 52 of the adapter 58. The adapter 58 provides both an access port 52 to cryogenic system 50 for purging and a conventional lead ball seal at 64. Specifically, a screw adjustment 59 retains a lead ball against the port at 64. When loosened, the screw adjustment 59 allows gas to flow around the lead ball, to or from access hole 52, and into or out of cryogenic system 50 through port 64.

Because the access hole 52 is designed to be easily coupled to a VCO type fitting, in-line pressure gauge 44 may be disconnected from VCO fitting port 42 of second T-joint 38 and conveniently connected to adapter 58 at access hole 52 as shown in FIG. 2. Preferably only a VCO fitting assembly 66 is coupled between the pressure gauge 44 and access hole 52. This minimizes the volume between the gauge 44 and the cryogenic system 50 and thus allows a fairly accurate reading of the system pressure.

VCO fittings have been employed throughout the manifold device 10 of FIG. 1 to increase efficiency of the device. The VCO fittings provide an o-ring seal, as opposed to a metal to metal contact seal, without the use of threads which have a tendency to wear after a period of use. Specifically, the repeated tightening of threads in the metal to metal seal become a contaminant source, a problem not encountered by VCO fittings. Also, coupling the system end of hose 48 to access hole 52 of adapter 58 requires the rotation of the manifold device relative to adapter 58 to screw the hose end into access hole 52, as is typically done in existing devices. Use of a VCO fitting to couple the manifold device 10 to cryogenic system 50 enables local rotational movement between female and male components 60, 61 of the VCO fitting without the twisting of hose 48 and the complications of rotating cryogenic system 50. Further, the design of a VCO fitting enables disconnection of the fitting without axial disturbance of the elements connected on opposite sides of the VCO fitting. Thus the seal between the device 10 of FIG. 1 and adapter 58 is broken locally at the connecting parts of VCO fitting 60, 61 to access hole 52 without axial movement of adapter 58 and device 10. Conveniently, loosening and tightening of a VCO fitting is accomplished by hand, by the twist of the female portion which generally comprises a finger-tight nut.

In contrast, flair fittings and Swagelok fittings with ferrules used in prior art devices cause axial distrubance upon disconnection and require wrenches for loosening and tightening. In addition these fittings begin to leak once they are worn and disformed. Such leaking prevents a leak proof seal from being achieved. Hence, the VCO fittings provide an easy and quick pressure-sealed connection without degradation upon repeated usage.

In the preferred embodiment VCO fittings of the type manufactured by Cajon Inc. of Macedonia, Ohio are used. An illustration of such a VCO fitting 70 is provided in FIG. 3. Male portion 72 and female portion 74 cooperate together in a tightening and loosening manner similar to that of a bolt and nut. O-ring 76, seated in male portion 72, enables the desired pressure seal. The male and female portions 72, 74 are connected to their respective elements by permanent seal as by welding or the like. Other VCO fittings are suitable.

Once the manifold device 10 of FIG. 1 is coupled to cryogenic system 50, the device is manually operated as follows. The user turns the handle 54 of the multiway control valve 14 to one setting to allow clean compressed working gas (i.e. helium) to enter and charge the cryogenic system 50 at a predetermined pressure level as indicated on the pressure gauge 44. After the desired amount of working gas has been allowed to enter the system, the user turns the handle 54 of control valve 14 to another setting to allow the venting of gas from the cryogenic system 50 through purge valve 26. The user allows the system 50 to be vented of gas to a level just above atmospheric pressure as indicated on pressure gauge 44. If the system pressure drops below 1 atm., there is the possibility of unwanted, ambient gases entering the cryogenic system 50. The user repeatedly and alternately charges and vents the cryogenic system 50 to raise the concentration level of the ga within the system 50 to a high level. Further, an accurate and consistent achievement of a particular high level concentration of a gas is easily obtained by the user counting the number of charging/purging cycles used.

In addition to obtaining high levels of concentration, the manifold device 10 of FIG. 1 may be used to pressurize a system 50 of interest. To accomplish such pressurization, the user turns the handle 54 of control valve 14 to the setting which allows gas to flow into the system 50. The pressure gauge 44 provides a reading of the increasing pressure of the system 50 during the charging of the system with the working gas. The user closes port 64 to system 50 by tightening screw adjustment 59 when the desired pressure level is reached as indicated on gauge 44. Once the system 50 is isolated from the manifold device 10, the control valve 14 is positioned at the setting which allows gas to be vented from the manifold 10 to ambient.

While the invention has been particularly shown and described with reference to a preferred embodiment thereof, it will be understood by those skilled in the art that various changes in form and details may be made therein without departing from the spirit and scope of the invention as defined by the appended claims.

We claim:

1. A manifold for transferring a working gas from a source to a cryogenic system and for venting unwanted gas out of the cryogenic system, the manifold comprising:

a check valve through which unwanted gas is vented to ambient;

a single multiway valve for determining the flow of the working and unwanted gases, at one setting the valve allowing the working gas to flow from the source into the cryogenic system, at a second setting the valve allowing the unwanted gas to flow out of the system and through the check valve; the multiway valve being repeatedly changeable between the one and second settings to alternately charge the system with the working gas and purge the system of unwanted gas respectively; and an o-ring fitting for coupling the manifold to the cryogenic system.

2. A manifold as claimed in claim 1 further comprising pressure adjusting means which enable the multiway valve at the one setting to allow the working gas to enter the system at a predetermined pressure level; and at the second setting the multi-way valve allowing venting of the unwanted gas through the check valve at a desired pressure level.

3. A manifold as claimed in claim 1 further comprising an inline pressure gauge for providing an indication of the pressure of the working gas entering the system and the pressure of the unwanted gas flowing out of the system.

4. A manifold as claimed in claim 1 wherein the working gas is helium.

5. A manifold as claimed in claim 1 further comprising an inline filter for preventing particulate matter from entering the system.

6. A manifold as claimed in claim 1 wherein the repeated and alternate changing of the multiway valve between the one and second settings provides an increased level of concentration of the working gas within the system.

7. A manifold as claimed in claim 1 wherein the repeated and alternate changing of the multiway valve between the one and second settings pressurizes the system.

8. A device for providing within a cryogenic system an increased level of concentration of a working gas, the working gas being supplied from a remote source, the device comprising:

a T-shaped manifold having a cross bar and a main section intersecting perpendicularly with the crossbar; one end of the cross bar being associated with the source, an opposite end of the cross bar connected to a purge valve, a crossbar end of the main section being at the intersection of the cross bar and main section, and a port end of the main section opposite the crossbar end of the main section being associated with the system;

a multiway valve positioned at the intersection of the cross bar and the cross bar end of the main section, the multiway valve at one setting allowing the working gas to flow from the source through the one end of the cross bar, through the main section, to the port end and into the system, and at a second setting allowing gas within the system to be vented out of the system through the main section, to the opposite end of the cross bar and out the purge valve;

the multiway valve being repeatedly changeable between the one and second settings to alternately charge the system with the working gas and purge the system of gas respectively such that an increased level of concentration of the working gas is provided within the system; and an o-ring fitting attached to the port end of the main section, the VCO fitting coupling the manifold to the system.

9. A device as claimed in claim 8 wherein the one end of the cross bar is connected to a pressure regulator of the source such that the working gas enters the cryogenic system at a predetermined pressure level when the multiway valve is set at the one setting.

10. A device as claimed in claim 8 wherein the purge valve is user adjustable to allow venting of the unwanted gas at a desired rate.

11. A device as claimed in claim 8 further comprising an inline pressure gauge mounted to the main section of the manifold for providing an indication of the pressure of the working gas entering the system and the pressure of the gas flowing out of the system.

12. A device as claimed in claim 11 further comprising an inline filter connected to the main section of the manifold between the pressure gauge and the port end, the inline filter preventing particulate contamination from entering the system.

13. A device as claimed in claim 8 wherein the main section further comprises an inline filter positioned between the crossbar end and port end, the filter preventing particulate contamination from entering the system.

14. A device as claimed in claim 8 wherein the working gas is helium.

15. A device as claimed in claim 8 wherein the alternate charging and purging of the system further pressurizes the system.

16. A method of purging and charging a cryogenic system to obtain an increased level of concentration of a working gas within the system, the steps comprising:

coupling a manifold to the system using an o-ring fitting; and alternately passing a working gas from a remote source through the manifold to the system and unwanted gas from the system through the manifold to ambient;

the manifold having a single multiway valve enabling such alternate passing of the working gas and gas from the system, a first setting of the multiway valve allowing the working gas to flow from the source into the system, a second setting allowing unwanted gas to flow out of the system through a check valve to ambient, alternate setting of the multiway valve between the first and second settings charging the system with the working gas and purging the system of unwanted gas, respectively, such that an increased level of concentration of the working gas is provided within the system.

17. A method as claimed as in claim 16 further comprising the step of regulating pressure of the working gas at a predetermined pressure before passing the working gas through the manifold to the system.

18. A method as claimed as in claim 16 further comprising the step of venting the unwanted gas at a desired rate through the check valve with the multiway valve set at the second setting.

19. A method as claimed as in claim 16 wherein the alternate charging and purging of the system pressurizes the system.

20. A method as claimed as in claim 16 wherein the working gas is helium.

21. A method as claimed as in claim 16 further comprising the step of reading the pressure of the working gas entering the system and the pressure of the unwanted gas flowing out the system from a single pressure gauge.

22. A method as claimed as in claim 21 further comprising the step of filtering the working gas before it enters the system to prevent particulates from entering the system.

* * * * *